US006173536B1

(12) United States Patent
Boyce

(10) Patent No.: US 6,173,536 B1
(45) Date of Patent: Jan. 16, 2001

(54) WORKSTATION

(75) Inventor: David L. Boyce, Damascus, PA (US)

(73) Assignee: Boyce Products, Ltd., Damascus, PA (US)

( * ) Notice: Under 35 U.S.C. 154(b), the term of this patent shall be extended for 0 days.

(21) Appl. No.: 09/216,164

(22) Filed: Dec. 18, 1998

(51) Int. Cl.[7] ..... E04F 19/06

(52) U.S. Cl. ..... 52/36.4; 52/220.1; 52/220.7; 52/239; 52/36.1; 160/135; 248/27.1; 312/223.6

(58) Field of Search ..... 52/36.1, 36.4, 52/220.1, 220.2, 220.7, 220.8, 238.1, 239, 287.1, 243.1; 312/223.6; 160/135; 174/4 B, 49, 99 R, 101, 100; 248/27.1, 68.1, 74.2

(56) References Cited

U.S. PATENT DOCUMENTS

| | | | | |
|---|---|---|---|---|
| 4,269,005 | | 5/1981 | Timmons . | |
| 4,429,934 | | 2/1984 | VandenHoek et al. . | |
| 4,716,692 | | 1/1988 | Harper et al. . | |
| 4,944,122 | * | 7/1990 | Wendt | 52/36 |
| 4,949,519 | | 8/1990 | Jeffers . | |
| 5,038,539 | | 8/1991 | Kelley et al. . | |
| 5,065,556 | * | 11/1991 | DeLong et al. | 52/221 |
| 5,172,530 | | 12/1992 | Fishel et al. . | |
| 5,209,035 | | 5/1993 | Hodges et al. . | |
| 5,219,406 | * | 6/1993 | Raz | 160/135 |
| 5,277,006 | * | 1/1994 | Ruster | 52/220.7 |
| 5,341,615 | | 8/1994 | Hodges et al. . | |
| 5,394,658 | | 3/1995 | Schreiner et al. . | |
| 5,511,349 | * | 4/1996 | Kelley et al. | 52/287.1 |
| 5,670,743 | * | 9/1997 | Welch et al. | 174/49 |
| 5,715,633 | | 2/1998 | Raz et al. . | |
| 5,746,034 | | 5/1998 | Luchetti et al. . | |
| 5,813,178 | * | 9/1998 | Edwards | 52/239 |
| 5,957,414 | * | 9/1999 | Perrignon de Troyes et al. | 248/27.1 |

* cited by examiner

*Primary Examiner*—Carl D. Friedman
*Assistant Examiner*—Yvonne M. Horton
(74) *Attorney, Agent, or Firm*—Rhodes & Mason, PLLC

(57) ABSTRACT

A workstation including at least two walls, each of the walls having opposed ends, an upper panel, and a lower panel beneath the upper panel, the lower panel including a center plate with horizontal, parallel upper and lower side opening raceways on opposite sides of the plate; and a support post having opposed connection faces, one of the faces being connected to an end of one of the walls and the other face being connected to an end of the other of the walls, the post including conduits extending between the connecting faces, whereby utilities can be connected from raceways on one of the walls to raceways on the other of the walls through the post. Releasable edge and end caps are frictionally attached to the exposed wall edges.

20 Claims, 3 Drawing Sheets

WORKSTATION

BACKGROUND OF THE INVENTION (1) Field of the Invention

The present invention relates generally to office workstations, and in particular to workstation walls that include raceways for standard UL rated, off-the-shelf, electrical and utility wiring devices, and to workstation walls having releasable, reversible edge caps that can be refurbished or refinished.

(2) Description of the Prior Art

Workstations, sometimes referred to as cubicles, are designed to provide a degree of privacy for the individual workers, while still permitting ease of rearrangement to accommodate changing office needs. Generally, workstations are comprised of a plurality of low walls that are joined at their abutting corners to enclose a workspace. For example, a workstation may have a back wall, a pair of parallel sidewalls, and a front wall that includes a doorway or access opening. Frequently, the back wall and/or one or both of the sidewalls also serve as a wall of an adjacent workstation.

A modern workstation is outfitted with various types of electrical and electronic equipment, such as computers, telephones, lighting, and the like, which require various kinds of electrical and data transmission wiring to connect the equipment to outlets. Thus, many prior art workstation walls make provision for conduits or raceways through which the wiring can be channeled from an external connection to the workstation equipment. Generally, these raceways are located in the wall interior, with a covering being placed over the raceways to hide the wiring and make the workstation more attractive.

For example, U.S. Pat. Nos. 5,209,035 and 5,746,034 to Hodges et al., describe workstation utility panels comprised of a panel frame having a foot portion to support the utility panel on the floor and spaced sides. A horizontal utility trough extends from one side of the panel to the other. A detachable cover panel covers at least one face of the panel frame. The utility trough is shaped with open ends, so that a continuous, uninterrupted horizontal channel exists when two panels are joined in an end to end relationship.

U.S. Pat. No. 5,341,615 to Luchetti et al. also describes a workstation panel structure formed of an open framework that includes vertical uprights with first and second pairs of horizontal stringers attached to the opposite faces of the vertical uprights, forming horizontal raceway cavities between the uprights which open to opposite sides of the frame. The panel also includes detachable cover panels to enclose the interior of the panel.

Prior art workstation panels are also known to include edge facing components or end caps for decorative purposes and to protect the panels. For example, U.S. Pat. No. 4,269,005 to Timmons shows partition panels with parallel grooves on their edges and end caps with U-shaped members that are attached by inserting the legs of the U into the channels. A corner cap also includes U-shaped channel members that are fitted into the grooves at the ends of the panel corner members.

U.S. Pat. No. 4,716,692 to Harper et al. describes attachment of panel walls and end caps using facing parallel grooves and connector plates that extend into the grooves. Clips are used to hold the end caps in place.

U.S. Pat. No. 4,949,519 to Jeffers describes attachment of end caps with metal clips that press against the inner sidewalls of an end cap.

Until the present invention, however, there has been no easily assembled workstation constructed primarily of wood components, and including wall sections providing separate isolated raceways for data and electrical components. Moreover, there has been no suggestion of a workstation walls with readily detachable edge and end caps that have the appearance of permanently attached wooden strips.

SUMMARY OF THE INVENTION

The present invention relates to a workstation and to a workstation wall panel that includes separate horizontal raceways for data and electrical wiring. The invention also relates to a workstation wall having readily detachable edge caps.

Generally, the workstation is comprised of at least two walls, and an end support post joining to the abutting ends of the walls to form a corner. It will be understood that a third or fourth wall may be jointed to the corner post. Each wall may be formed of more than one section, so long as one of the sections is designed in accordance with the following description to enclose electrical wiring, computer cables and the like. The outer, i.e., upper and side, edges, of the workstation walls may include trim pieces attached in a unique manner as hereinafter described.

Preferably, each wall of the workstation is comprised of stacked, vertically aligned, upper and lower sections, joined at their ends to vertical corner support members. The corner support members or posts may be attached at their lower ends to a horizontal base member that extends beneath the wall.

The lower wall section is comprised of a center vertical plate with spaced upper, center and lower horizontal spacers projecting from each side. The spaces on each side of the center plate between the upper and center spacers, and between the center and lower spacers, form separate parallel, side opening, isolated raceways for cables and wiring. For example, the upper space can be used as a data raceway, and the lower space can be used as an electrical raceway. Thus, two raceways are available on each side of the workstation wall.

The center plate includes through openings so that junction boxes and outlets can be mounted onto the panel from either side, and joined to cable or wiring. Preferably, these openings are spaced along the raceways between the spacers. The openings may be of different shapes and sizes to accommodate different types and sizes of junction boxes and outlets.

Each support member or post is preferably of a rectangular cross-section, and includes a plurality of wall attachment faces, depending upon the number of walls to be joined to the post. That is, the post may have two, three or four wall attachment faces. Each wall attachment face includes through openings or holes, extending though the post to join with the openings in other attachment faces to form conduits through the post between attachment walls.

The wall ends are preferably connected at their ends to the wall attachment face of a post with releasable fasteners having one part attached to the wall attachment face and a mating part attached to the ends of some or all of the spacers forming a part of the center plate. These fasteners are positioned between on either side of the wall attachment openings, and the ends of the center plate include cut-outs between the spacers and adjacent the wall attachment openings, so that the wiring can be easily threaded through the support post conduits and the raceways.

In order to conceal the interior structure and wiring, cover plates are attached on either side of the center web plate using releasable fasteners, such as hook-and loop fasteners of the type sold under the trademark Velcro. For example, mating sections of the releasable fasteners may be attached to the inner faces of the cover plates and to the outer surfaces of the spacers. The cover plates may be formed of rectangular panels of a suitable material, such as pressed board, dry wall, corrugated paperboard, or similar material, with an optional plastic or fabric outer covering. Knock-out sections may be cut in the cover panels and aligned with outlets in the center plate so that openings can be readily formed in the cover plates to access the desired openings.

The upper section of the wall may be formed in various ways depending upon the privacy needs of the workstation, manufacturing costs, and aesthetic considerations. For example, the upper wall may be formed of a framework with upper, lower and spaced side members, and cover plates attached to the outer faces of the framework. With this configuration, the upper section is desirably of the same width as the lower section, and the cover plates are faced with the same surfacing material. Alternatively, the upper section can be a glass panel held within a framework.

The upper and lower sections can be simply positioned in stacked vertical alignment. No attachment between the sections is required, since the ends of both sections are attached to the corner support members. Alternatively, a horizontal spacer, such as an elongated, horizontal wooden strip, can be positioned between the top of the lower section and the bottom of the upper section.

The upper edge of the workstation wall and other exposed edges, such as the edges framing a doorway into the workstation, may be covered with releasably attached edge caps. If so, a mounting plate is attached to the wall edges. This mounting plate has a pair of spaced, outer facing parallel grooves parallel to the wall. The end cap to be attached to the wall edge includes a corresponding pair of spaced, inner facing parallel grooves. Edge caps are then releasably attached to the mounting plates using releasable attachment pieces having a thickness approximating the groove widths. Preferably, the attachment pieces are disk-shaped, and may be of in the shape of a corrugated oval disk profile commonly known as biscuits in woodworking.

To mount the caps, one or more biscuits are inserted into each mounting plate groove by pressing one side of the biscuit into the groove. The edge cap is then pressed onto the mounting plate so that the opposite side of the biscuit is inserted into the mating edge cap groove, where it is held by friction. As a result, the edge cap is held securely onto the wall edge. However, if desired, the edge cap can be easily pulled off of the wall edge.

Similarly, corner or end caps can be mounted at the wall corners at the abutting ends of the edge caps. For this purpose, the edge caps each have a groove in the end face the end caps, the groove being parallel to the outer surface of the edge cap. The facing ends of the end caps also include grooves facing the grooves in the ends of the edge caps. Biscuits are then inserted into the facing grooves and the end cap is pressed against the ends of the edge caps.

Accordingly, one aspect of the present invention is to provide a workstation wall comprising a vertical upper panel having opposed ends; a vertical lower panel having opposed ends positioned beneath the upper panel, the lower panel including a center vertical plate having opposed outer and inner side walls and upper and lower edges, and horizontal upper, center and lower spacers attached to at least one side wall of the plate, whereby a first side opening raceway is formed by the one side wall and the upper and center spacers, and a parallel second side opening raceway is formed by the one side wall and the center and lower spacers; a support post connected to one end of the upper panel and one end of the lower panel; and a cover plate releasably attached to one side of the lower panel.

Another aspect of the invention is to provide a workstation comprising at least two walls, each of the walls having opposed ends, an upper panel, and a lower panel beneath the upper panel, the lower panel including a center plate with inner and outer sides, and horizontal, parallel upper and lower side opening raceways on each side of the plate; and a support post having opposed connection faces, one of the faces being connected to an end of one of the walls and the other face being connected to an end of the other of the walls, the post including conduits extending between the connecting faces, whereby utilities can be connected from raceways on one of the walls to raceways on the other of the walls through the post.

Still another aspect of the invention is to provide a workstation wall comprising a panel having an exposed edge; a mounting plate attached to the exposed edge, the mounting plate having an outer surface including an axially aligned groove; an edge cap having an inner surface including an axially aligned groove; and disk-shaped connectors having a first edge inserted into and frictionally held by the mounting plate groove, and an opposed edge inserted into and frictionally held by the edge cap groove, whereby the edge cap is releasably secured to the upper edge of the panel.

These and other aspects of the present invention will become apparent to those skilled in the art after a reading of the following description of the preferred embodiment.

DETAILED DESCRIPTION OF THE INVENTION

Figure 1:
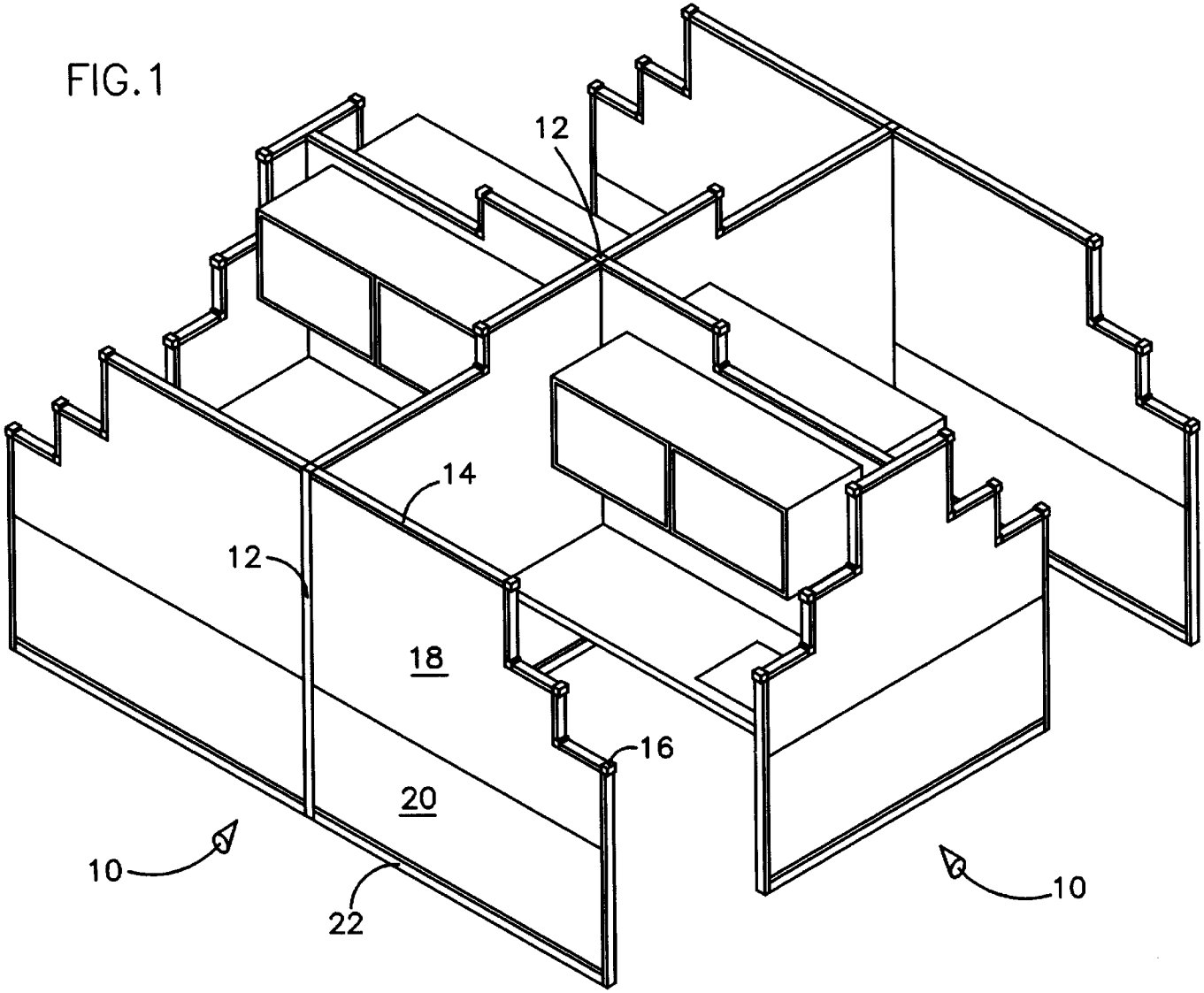
FIG. 1 is a perspective view of a representative group of workstations.
Figure 2:
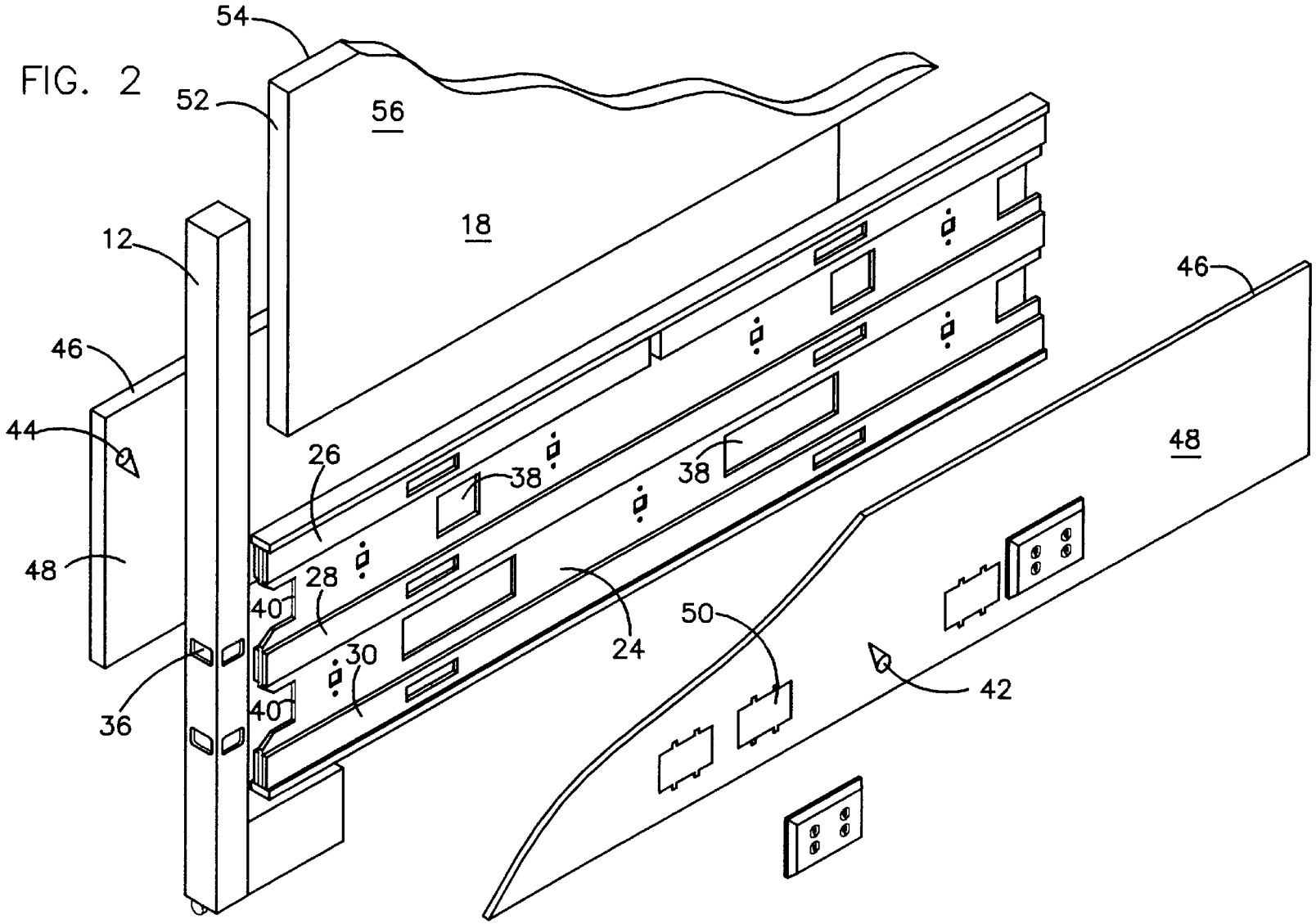
FIG. 2 an exploded perspective view of a wall section.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Generally, a preferred embodiment of the workstation is comprised of a plurality of walls, generally 10, connected at their ends by support posts, generally 12, and faced at their exposed upper and side edges with edge caps 14 and end caps 16. Each wall 10 is comprised of an upper wall section 18 and a lower wall section 20. Horizontal base members 22 extend beneath walls 10 and posts 12.

Lower wall section 20 is comprised of center vertical plate 24 with opposed inner and outer faces that may be made of plywood or other type of fabricated board material. Horizontal spacers 26, 28 and 30, which may also be of wood, are attached at the upper edge, center and lower edge, respectively, of each face of plate 24, and project outwardly therefrom. The outwardly extending C-shaped area formed by spacers 26 and 28, and the outer face of plate 24, forms a first outer facing, side-opening raceway extending from one edge of wall 10 to the other edge, while the C-shaped area formed by spacers 28 and 30 and the outer face of plate 24, forms a second outer facing, side-opening raceway beneath and parallel to the first raceway, also extending between the side edges of wall 10, thereby forming separate raceways for data cables and electrical wiring.

Similarly, the inwardly extending C-shaped area formed by spacers 26 and 28, and the inner face of plate 24, forms a first inner facing, side-opening raceway extending from one edge of wall 10 to the other edge, while the C-shaped area formed by spacers 28 and 30 and the inner face of plate 24, forms a second inner facing, side-opening raceway beneath and parallel to the first raceway, also extending between the side edges of wall 10, The ends of panel 20 are attached to post 12 by joining the ends of spacers 26–30 to post 12. Post 12 includes through openings 36 that lie in a horizontal plane and join to form conduits through post 12 so that wiring or cable can be extended though post 12 between walls 10. Plate 24 also includes through openings 38 of various dimensions between spacers 26 and 28, and between spacers 2 and 30, for mounting of junction boxes and outlets. The ends of plate 24 include cut-outs 40 between spacer pairs 26/28 and 28/30 adjacent openings 36 in post 12 to facilitate threading of utilities through post 12 and into the wall raceways.

Cover plates, generally 42 and 44, are releasibly attached with hook and loop fasteners 46 to the outer faces of spacers 26–30. Cover plates 42 and 44 are each formed of an inner panel 46 covered by wall covering 48. Panels 42 and 44 include knock-out sections 50 aligned with cut-outs 38 in center plate 24.

Wall upper section 18 is constructed of framework 52 and cover plates 54 comprising an inner panel 56 covered with wall covering to match wall covering 48. The ends of wall section 18 are attached to the adjacent attachment face of post 12.

Figure 3:
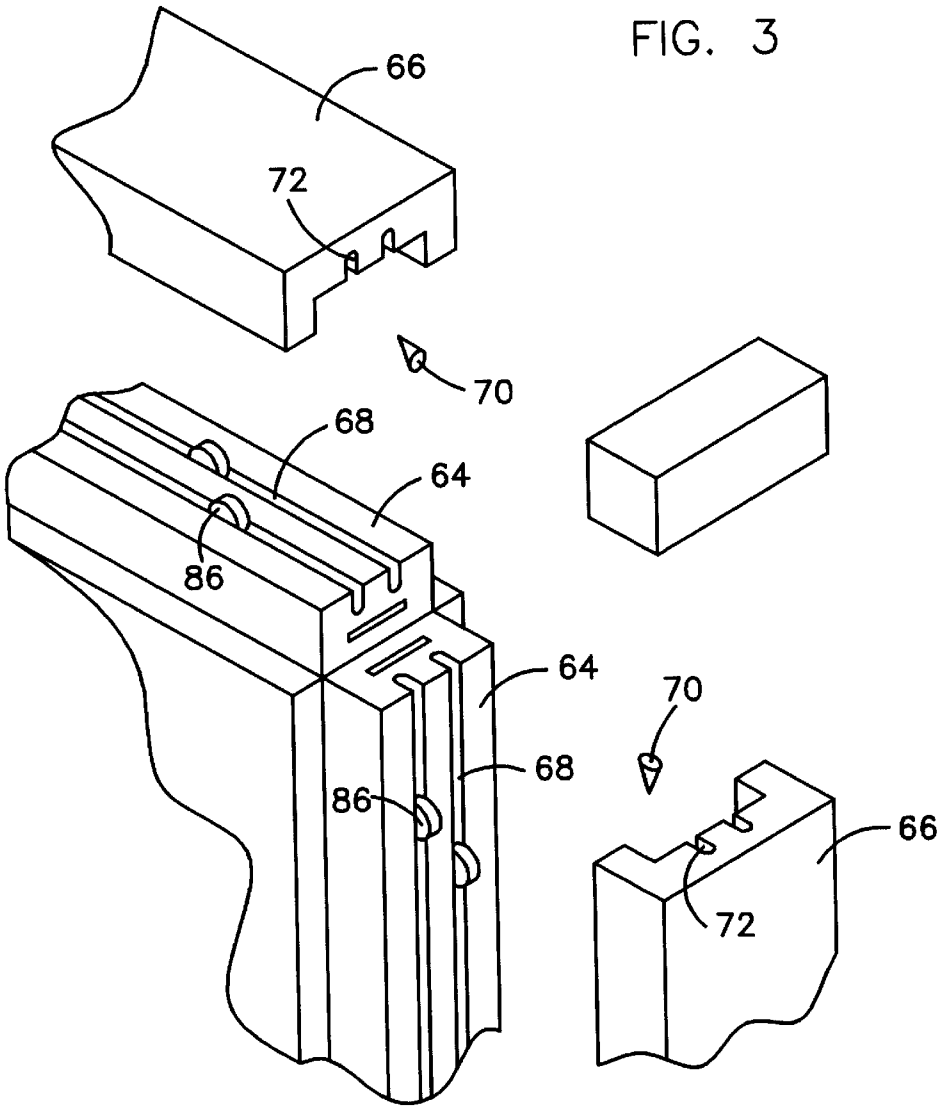
FIG. 3 is a detailed exploded corner view of the edge and end caps along the edges of a wall.
Figure 4:
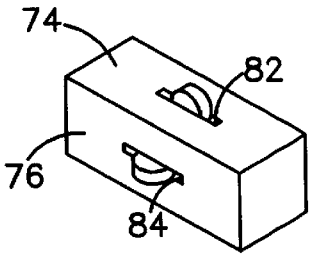
FIG. 4 is a detailed view of the lower side of the end cap of FIG. 3.

As best illustrated in FIGS. 3 and 4, the unattached upper and side edges of wall sections 18 and 20 are faced with edge caps 14. End caps 16 are mounted at the juncture of edge caps 14 at outside corners. Edge caps 14 are comprised of a mounting section 64 that is covered by a cap section 66. Mounting section 64 is of a rectangular cross-section, with a lower face attached along the center of the wall edge; spaced, parallel side walls, and an upper wall including a pair of spaced parallel grooves 68.

Cap section 66 is of a rectangular cross-section with an inner face that includes a U-shaped slot 70 having interior dimensions corresponding to the exterior dimensions of mounting section 64, so that section 66 will snugly fit over section 64. Slot 70 includes a bottom wall with a pair of spaced grooves 72 that align with grooves 68 on mounting section 64 when mounting section 64 is inserted into slot 70. Grooves 68 and 72 extend the entire length of sections 64 and 66, respectively, so that the ends of the slots are exposed at the ends of the sections.

End cap 16 is of a generally cubical shape, and is positioned to join the ends of two edge caps. Cap 16 includes a first connecting face 74 to be positioned toward a first edge cap and a second connecting face 76 toward a second edge cap. Faces 74 and 76 meet at a 90° angle. The width of end cap 16 is equal to the width of edge cap 14.

Face 74 includes a pair of grooves 82 extending partially across face 74 and aligned with the ends of grooves 68 and 72 on the horizontal edge cap. Similarly, face 76 includes a pair of grooves 84 extending partially across face 76 and aligned with the ends of grooves 68 and 72 on the vertical edge cap.

Mounting section 64 is attached to the top and sides of wall 10 with fasteners, e.g., screws. Frictional disk-shaped attachment members, shown as biscuits 86, are then inserted into grooves 68. Cap section 66 is then pressed onto mounting section 64, with mounting section 64 being inserted into slot 70, and the edges of biscuits 86 being inserted into slots 68 and 72 to frictionally hold sections 64 and 66 together.

Biscuits 86 are then inserted into slots 82 and 84 of end cap faces 74 and 76. End cap 16 is then pressed against the ends of the edge caps so that the opposite sides of biscuits 86 are inserted into the ends of slots 68 and 72 to frictionally hold end cap 16 against the ends of edge caps 14, thereby completing the wall trim.

Certain modifications and improvements will occur to those skilled in the art. Such modifications and improvements have been deleted herein for the sake of conciseness and readability but are properly within the scope of the follow claims.

What is claimed is:

1. A workstation wall comprising:

a) a vertical upper panel having opposed ends;

b) a vertical lower panel having opposed ends positioned beneath said upper panel, said lower panel including a center vertical plate having opposed outer and inner side walls and upper and lower edges, and horizontal upper, center and lower spacers attached to at least one side wall of said plate, whereby a first side opening raceway is formed by said one side wall and said upper and center spacers, and a parallel second side opening raceway is formed by said one side wall and said center and lower spacers;

c) a support post having opposed connection faces, one of said faces abutting an end of said lower panel, each face including through openings, the through openings of said faces joining to form utility conduits extending between said connecting faces; and d) a cover plate releasibly attached to one side of said lower panel.

2. The workstation wall of claim 1, wherein said center plate includes end cut-out sections between said upper and center spacers, and between said center and lower spacers.

3. The wall of claim 1, wherein said lower panel cover plate is attached to said spacers with hook-and-loop fasteners.

4. The wall claim 1, wherein said post is attached to the ends of said spacers.

5. The wall of claim 1, further including a horizontal support base beneath said lower wall panel.

6. The wall of claim 1, wherein said center plate includes cut-outs extending through said plate in communication with said raceways.

7. The wall of claim 6, wherein said cover plate includes knock-out sections aligned with said cut-outs.

8. The wall of claim 1, wherein upper, center and lower spacers extend form both sides of said center plate to form upper and lower side opening parallel raceways on both sides of said plate.

9. The wall of claim 8, including detachable cover plates on both sides of said lower panel.

10. A workstation comprising:

a) at least two walls, each of said walls having opposed ends, an upper panel, and a lower panel beneath said upper panel, said lower panel including a center plate with inner and outer sides, and horizontal, parallel upper and lower side opening raceways on each side of said plate; and b) a support post having opposed connection faces, one of said faces abutting an end of one of said walls and the other face abutting an end of the other of said walls, each face including through openings, the through openings of said faces joining to form utility conduits extending between said connecting faces, whereby utilities can be connected from raceways on one of said walls to raceways on the other of said walls through said post.

11. The workstation of claim 10, wherein the center plate of each of said walls includes end cut-out sections at the ends of said raceways adjacent said post to form an open space adjacent said conduits.

12. The workstation of claim 10, wherein said raceways are covered with detachable cover plate.

13. The workstation of claim 10, wherein the center plate of each of said walls includes cut-outs extending through said plate in communication with said raceways.

14. A workstation wall comprising:

a) a panel having an exposed edge;

b) a mounting plate attached to said exposed edge, said mounting plate having an outer surface including an axially aligned groove;

c) an edge cap having an inner surface including an axially aligned groove; and d) disk-shaped connectors having a first edge inserted into and frictionally held by said mounting plate groove, and an opposed edge inserted into and frictionally held by said edge cap groove, whereby said edge cap is releasibly secured to the upper edge of said panel.

15. A workstation wall comprising:

a) a vertical upper panel having opposed ends;

b) a vertical lower panel having opposed ends positioned beneath said upper panel, said lower panel including a center vertical plate having opposed outer and inner side walls and upper and lower edges, and horizontal upper, center and lower spacers attached to at least one side wall of said plate, whereby a first side opening raceway is formed by said one side wall and said upper and center spacers, and a parallel second side opening raceway is formed by said one side wall and said center and lower spacers;

c) a support post connected to one end of said upper panel and one end of said lower panel; and d) a cover plate releasibly attached to one side of said lower panel with hook-and-loop fasteners.

16. The wall of claim 15, further including a horizontal support base beneath said lower wall panel.

17. The wall of claim 15, wherein said center plate includes cut-outs extending through said plate in communication with said raceways.

18. The wall of claim 15, wherein said cover plate includes knock-out sections aligned with said cut-outs.

19. The wall of claim 15, wherein upper, center and lower spacers extend form both sides of said center plate to form upper and lower side opening parallel raceways on both sides of said plate.

20. The wall of claim 15, including cover plates releasibly attached to the inner and outer side walls of said lower panel with hook-and-loop fasteners.

* * * * *